US009273624B2

(12) United States Patent
Kobayashi

(10) Patent No.: US 9,273,624 B2
(45) Date of Patent: Mar. 1, 2016

(54) CONTROL SYSTEM HAVING IDLE SPEED CONTROL LEARNING AND METHOD HAVING IDLE SPEED CONTROL LEARNING FOR INTERNAL COMBUSTION ENGINE

(75) Inventor: Yukio Kobayashi, Kasugai (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 952 days.

(21) Appl. No.: 13/423,568

(22) Filed: Mar. 19, 2012

(65) Prior Publication Data

US 2012/0239280 A1 Sep. 20, 2012

(30) Foreign Application Priority Data

Mar. 18, 2011 (JP) ..... 2011-061091

(51) Int. Cl.

| | |
|---|---|
| ***F02D 41/16*** | (2006.01) |
| ***F02D 41/00*** | (2006.01) |
| ***F02D 41/24*** | (2006.01) |
| *F02D 31/00* | (2006.01) |

(52) U.S. Cl.

CPC ..... *F02D 41/16* (2013.01); *F02D 41/0097* (2013.01); *F02D 41/248* (2013.01); *F02D 41/2464* (2013.01); *F02D 31/003* (2013.01); *F02D 2200/1015* (2013.01)

(58) Field of Classification Search

CPC ..... F02D 2200/1015; F02D 31/003; F02D 41/0097; F02D 41/16; F02D 41/2464; F02D 41/248; F02D 41/2429–41/2483

USPC ..... 701/102, 111, 113; 123/179.4, 339.1, 123/339.14, 339.15, 339.19, 376

See application file for complete search history.

(56) References Cited

U.S. PATENT DOCUMENTS

| | | | | |
|---|---|---|---|---|
| 4,580,535 | A * | 4/1986 | Danno et al. | 477/111 |
| 6,032,519 | A * | 3/2000 | Ishii et al. | 73/114.36 |
| 8,170,778 | B2 * | 5/2012 | Ando et al. | 701/112 |
| 2001/0002591 | A1 * | 6/2001 | Majima | 123/406.24 |
| 2003/0164166 | A1 * | 9/2003 | Takeuchi et al. | 123/674 |
| 2009/0319158 | A1 * | 12/2009 | Ando et al. | 701/106 |
| 2011/0118951 | A1 * | 5/2011 | Watanabe et al. | 701/101 |

FOREIGN PATENT DOCUMENTS

| | | | |
|---|---|---|---|
| JP | 09189252 | A | 7/1997 |
| JP | 2003293832 | A | 10/2003 |
| JP | 2009-281328 | A | 12/2009 |
| JP | 2010-014031 | A | 1/2010 |

* cited by examiner

*Primary Examiner* — Erick Solis
*Assistant Examiner* — Carl Staubach
(74) *Attorney, Agent, or Firm* — Dinsmore & Shohl LLP

(57) ABSTRACT

A control system for an internal combustion engine that performs learning of a throttle opening degree during idle operation, at which a target idle speed can be obtained, the control system comprising a control section that is configured to use a first learned value and a second learned value as learned values of the throttle opening degree during idle operation and to update the first learned value when a state of combustion is not deteriorated, and update the second learned value when the state of combustion is deteriorated.

12 Claims, 2 Drawing Sheets

CONTROL SYSTEM HAVING IDLE SPEED CONTROL LEARNING AND METHOD HAVING IDLE SPEED CONTROL LEARNING FOR INTERNAL COMBUSTION ENGINE

CROSS REFERENCE TO RELATED APPLICATIONS

This application claims priority to Japanese Patent Application No. 2011-061091 filed on Mar. 18, 2011, which is incorporated herein by reference in its entirety including the specification, drawings and abstract.

BACKGROUND OF THE INVENTION

1. Field of the Invention

The invention relates to a control system and method for an internal combustion engine that performs learning of a throttle opening degree, at which a target idle speed can be obtained.

2. Description of Related Art

In an internal combustion engine such as that mounted on a vehicle, learning is performed to acquire a throttle opening degree, at which a target idle speed can be obtained. In the case where the state of combustion is temporarily deteriorated, for example because of occurrence of a misfire, during idle operation, the throttle opening degree at which the target idle speed can be obtained increases. Therefore, if learning is performed while the state of combustion is deteriorated, the learned value of the throttle opening degree may become larger than that for normal operation. In this case, while the learned value of the throttle opening degree is increased once, the learned value of the throttle opening degree is returned to the value for normal operation through re-learning when the deteriorated state of combustion is resolved.

Japanese Patent Application Publication No. 2010-014031 (JP 2010-014031 A) discloses a technique that enables continuation of learning of a throttle opening degree, even during deteriorated combustion, by relaxing the conditions on engine speed variations related to execution of learning control of the throttle opening degree when deterioration in the state of combustion is found.

In recent years, meanwhile, hybrid vehicles that include two driving power sources, namely an internal combustion engine and an electric motor, and vehicles that perform idle stop control to automatically stop an internal combustion engine during idling have been put into practice. In such vehicles, the frequency of idle operation is low, and hence there are fewer chances to learn a throttle opening degree during idle operation. Therefore, once the learned value of the throttle opening degree is varied by deterioration in combustion, there may be no chance for re-learning, and the value acquired during deteriorated combustion may be used continuously thereafter.

Such an issue can be suppressed to some degree by prohibiting learning, securing a longer learning period so that learning is performed not only based on a deteriorated state of combustion, or the like when the state of combustion is deteriorated. In such cases, however, it may take more time to complete learning, which may deteriorate the fuel efficiency.

The above issue may likewise occur in internal combustion engines other than those mounted on hybrid vehicles and vehicles that perform idle stop control if there are fewer chances to learn a throttle opening degree during idle operation.

SUMMARY OF THE INVENTION

The invention provides a control system and method for an internal combustion engine that can perform learning of a throttle opening degree during idle operation with accuracy even if the frequency of learning is low.

A first aspect of the invention is a control system for an internal combustion engine that performs learning of a throttle opening degree at which a target idle speed can be obtained, the control system including a control section that is configured to use a first learned value and a second learned value as learned values of the throttle opening degree during idle operation and to update the first learned value when a state of combustion is not deteriorated, and update the second learned value when the state of combustion is deteriorated.

A second aspect of the invention is a control method for an internal combustion engine that performs learning of a throttle opening degree during idle operation, at which a target idle speed can be obtained, the control method including: using a first learned value and a second learned value as learned values of the throttle opening degree during idle operation; updating the first learned value when a state of combustion is not deteriorated; and updating the second learned value when the state of combustion is deteriorated.

In the invention, the first learned value is updated during normal operation, and the second learned value is updated when the state of combustion is deteriorated. Therefore, the effect of deterioration in the state of combustion is not reflected on the first learned value, which makes it possible to avoid a situation where an inappropriate value is set as the learned value because of temporary deterioration in the state of combustion. In addition, learning is performed by updating the second learned value even when the state of combustion is deteriorated, which prevents it from taking a long time to complete learning. Thus, according to the invention, learning can be performed to acquire a throttle opening degree during idle operation with accuracy even if the frequency of learning is low.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
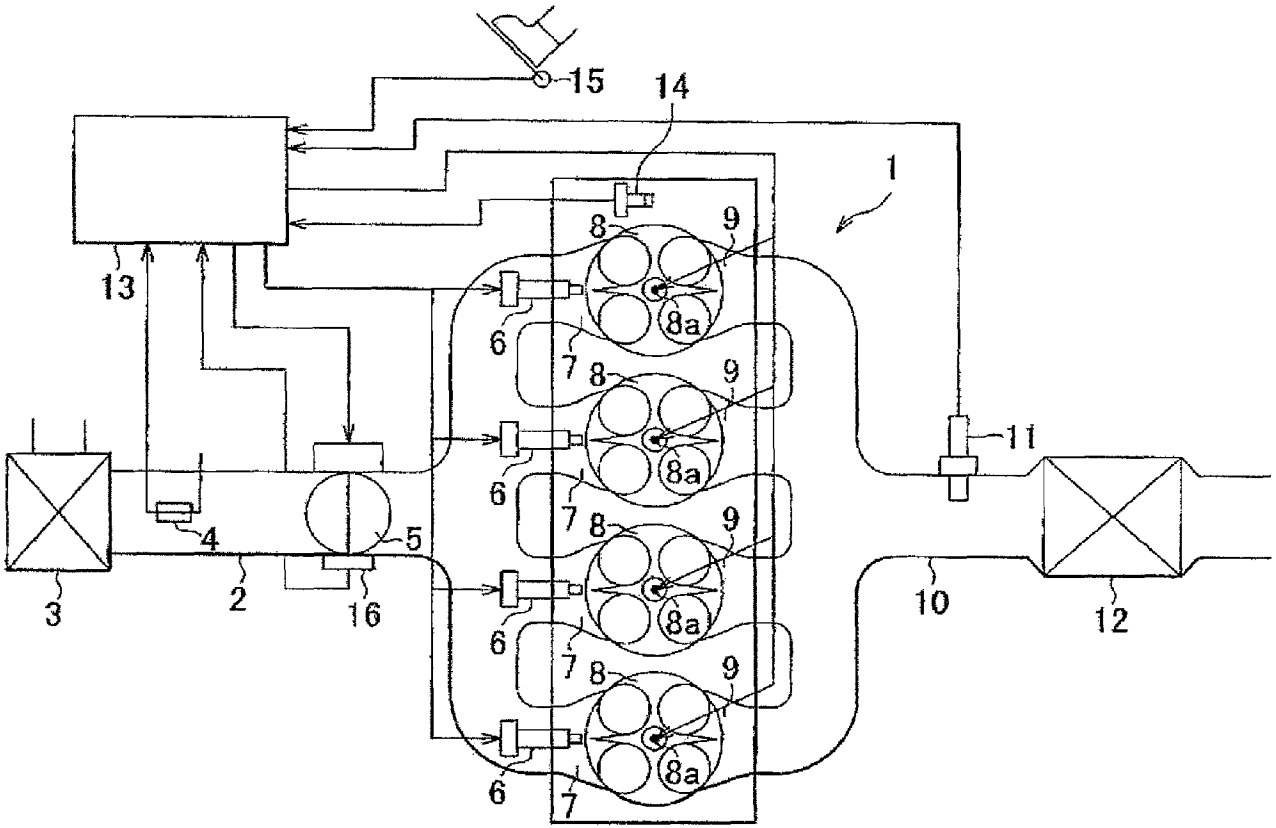
FIG. 1 is a diagram that schematically shows a configuration of a control system for an internal combustion engine in accordance with an embodiment of the invention.
Figure 2:
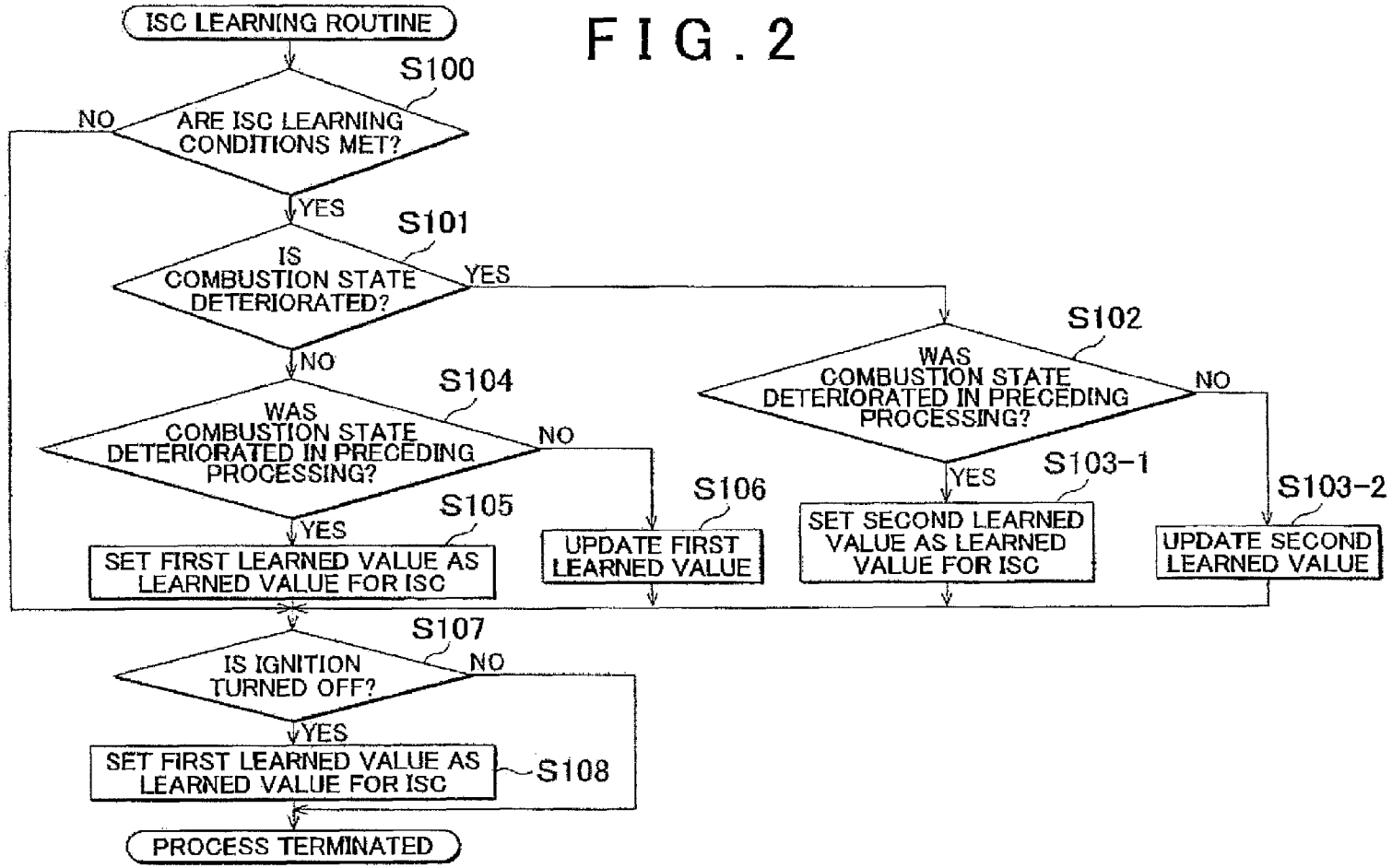
FIG. 2 is a flowchart that shows a process procedure of an ISC learning routine adopted in the embodiment.

A control system for an internal combustion engine according to an embodiment of the invention will be described in detail below with reference to FIGS. 1 and 2. The control system according to the embodiment is applicable to an internal combustion engine that is mounted on a hybrid vehicle that includes two driving power sources, namely the internal combustion engine and a motor.

First, a configuration of the control system for an internal combustion engine according to the embodiment will be described with reference to FIG. 1. An intake passage 2 of an internal combustion engine 1 shown in the drawing is provided with an air cleaner 3 that purifies intake air, an airflow meter 4 that detects the amount of the intake air, and a throttle valve 5 that adjusts the amount of the intake air, which are arranged in this order from the upstream side. The intake passage 2 is divided into branches for respective cylinders at a location downstream of the throttle valve 5, and each of the branches is connected to a combustion chamber 8 via an intake port 7, which is provided with an injector 6 that injects fuel into the intake air. The combustion chamber 8 is provided with an ignition plug 8*a* that ignites a mixture of the intake air and the fuel introduced into the combustion chamber 8. The combustion chamber 8 is connected to an exhaust passage 10 via an exhaust port 9. The exhaust passage 10 is provided with an air-fuel ratio sensor 11 that detects the air-fuel ratio of the combusted air-fuel mixture based on the concentration of oxygen in exhaust air and a catalytic converter 12 that purifies the exhaust air.

The internal combustion engine 1 is controlled by an electronic control unit 13. The electronic control unit 13 includes a central processing unit (CPU) that executes various computational processes for engine control, a read only memory (ROM) that stores programs and data for engine control, and a random access memory (RAM) that temporarily stores the results of computation performed by the CPU, the results of detection performed by the sensors, and so forth. The electronic control unit 13 also includes an input port that receives signals such as signals detected by the sensors and an output port that outputs signals such as command signals.

The input port of the electronic control unit 13 receives signals detected by the airflow meter 4 and the air-fuel ratio sensor 11 discussed above. The input port of the electronic control unit 13 also receives signals detected by a crank angle sensor 14 that detects the rotational angle of a crankshaft that is an engine output shaft, an accelerator pedal sensor 15 that detects the amount of operation of an accelerator pedal, a throttle sensor 16 that detects the degree of opening of the throttle valve 5 (throttle opening degree), and so forth. Meanwhile, the output port of the electronic control unit 13 outputs command signals to drive circuits for the throttle valve 5, the injectors 6, the ignition plugs 8*a*, and so forth discussed above.

The electronic control unit 13 calculates variations in engine speed during operation of the engine based on the results of detection performed by the crank angle sensor 14 to find deterioration in the state of combustion due to a misfire or the like based on the magnitude of the variations.

The electronic control unit 13 also executes idle speed control (ISC), as part of engine control, such that the idle speed of the internal combustion engine 1 becomes a target value. The ISC is performed by feedback adjusting the throttle opening degree so as to reduce the deviation between the actual rotational speed during idle operation and the target idle speed. Then, the electronic control unit 13 performs learning to acquire a throttle opening degree at which the target idle speed can be obtained based on the results of the ISC, and stores the acquired value as a learned value.

In the embodiment, two learned values are used as the learned value of the throttle opening degree during idle operation. A first learned value is updated when the state of combustion is not deteriorated, and a second learned value is updated when the state of combustion is deteriorated.

In the embodiment, in addition, the first learned value is used to control the throttle opening degree during idle operation when the state of combustion is not deteriorated, and the second learned value is used to control the throttle opening degree during idle operation when the state of combustion is deteriorated, until the deteriorated state is resolved. In the embodiment, moreover, the first learned value is used to control the throttle opening degree during idle operation when the engine is started next time after an ignition system is turned off. Note that in the invention, turning on and turning off of the ignition system are not limited to the turning on and the turning off of the ignition switch and include the automatic turning on and the automatic turning off of the ignition system performed by idle stop control.

Next, the process related to learning of a throttle opening degree during idle operation according to the embodiment will be described in detail with reference to FIG. 2. The ISC learning routine shown in the drawing is executed periodically and repeatedly by the electronic control unit 13.

When the routine is started, it is first determined in step S100 whether conditions for ISC learning, such as whether the engine is idling stably and whether the engine has been warmed up, are met. If the conditions for ISC learning are met, the process proceeds to step S101. If not, the process proceeds to step S107.

When the process proceeds to step S101, it is determined in step S101 whether the state of combustion is deteriorated. If deterioration is found in the state of combustion (S101: YES), it is determined in step S102 whether the deterioration had been found in the state of combustion in the preceding processing of the routine. If the deterioration had been found in the state of combustion in the preceding processing of the routine (S102: YES), the second learned value is set as the learned value for use in the (ISC learned value) in step S103-1. If not (S102: NO), the second learned value is updated based on the current throttle opening degree in step S103-2. Thereafter, the process proceeds to step S107.

On the other hand, if deterioration in the state of combustion is not found (S101: NO), it is determined in step S104 whether the deterioration had been found in the state of combustion in the preceding processing of the routine. If the deterioration had been found in the state of combustion in the preceding processing of the routine (S104: YES), the first learned value is set as the learned value for use in the ISC (ISC learned value) in step S105. If not (S104: NO), the first learned value is updated based on the current throttle opening degree in step S106. Thereafter, the process proceeds to step S107.

When the process proceeds to step S107, it is determined in step S107 whether the ignition system is turned off. If the ignition system is not turned off (S107; NO), the current processing of the routine is terminated. On the other hand, if the ignition system is turned off (S107: YES), the first learned value is set as the learned value for use in the ISC performed when the ignition system is turned on next time in step S108. Thereafter, the current processing of the routine is terminated.

The control system for an internal combustion engine according to the embodiment described above can achieve the following effects. (1) In the embodiment, the first learned value is updated as the learned value related to learning of a throttle opening degree when the state of combustion is not deteriorated, and the second learned value is updated as the learned value related to the learning of the throttle opening degree when the state of combustion is deteriorated. Therefore, the effect of deterioration in the state of combustion is not reflected on the first learned value, which makes it possible to avoid a situation where an inappropriate value is set as the learned value because of temporary deterioration in the state of combustion. In addition, learning is performed by updating the second learned value even when the state of combustion is deteriorated, which prevents it from taking a long time to complete learning. Thus, according to the embodiment, learning of a throttle opening degree during idle operation can be performed with accuracy even if the frequency of learning is low.

(2) In the embodiment, the throttle opening degree during idle operation is controlled using the first learned value when the engine is started next time after the ignition is turned off Even if the state of combustion of the internal combustion engine is deteriorated once, the deterioration in the state of combustion is often resolved when the engine is started next time after the ignition system is turned off in the case where the factor of the deterioration is temporary. Therefore, the ISC can be performed appropriately by controlling the throttle opening degree during idle operation with the use of the first learned value after the ignition system is turned on.

(3) In the embodiment, the throttle opening degree during idle operation is controlled using the second learned value when the state of combustion is deteriorated, until the deteriorated state is resolved. Therefore, the ISC can be performed appropriately even when the state of combustion is deteriorated.

The embodiment described above may be modified as described below.

In the embodiment described above, the second learned value is used for the ISC when the state of combustion is deteriorated, and the learned value for use in the ICS is returned to the first learned value when the deterioration in the state of combustion is resolved. Once the state of combustion is deteriorated, in some cases, the state of combustion is deteriorated again even after the deteriorated state is temporarily resolved. When the frequency of such recurrence of the deterioration in the state of combustion is high, the second learned value may be used for the ISC until the ignition system is turned off after the state of combustion is deteriorated.

In the embodiment described above, the first learned value is used to control the throttle opening degree during idle operation when the engine is started next time after the ignition system is turned off. In the case where deterioration in the state of combustion before the ignition system is turned off is not temporary, the deterioration in the state of combustion may be continued even when the engine is started next time. Thus, in the case where it is determined that the deterioration in the state of combustion is continued even after the engine is started, the second learned value may be used to control the throttle opening degree during idle operation when the engine is started next time after the ignition system is turned off In the embodiment described above, deterioration in the state of combustion is detected based on variations in engine speed. However, presence or absence of deterioration in the state of combustion may be determined using other parameters such as the results of detecting the in-cylinder pressure during combustion.

In the embodiment described above, the invention is applied to an internal combustion engine that is mounted on a hybrid vehicle that includes two driving power sources, namely the internal combustion engine and a motor. However, the invention is likewise applicable to other internal combustion engines. Nevertheless, the invention is particularly suitable for application to internal combustion engines in which the frequency of idle operation is low and in which there are limited chances to learn a throttle opening degree during idle operation at which a target idle speed can be obtained, such as an internal combustion engine that is mounted on the hybrid vehicle described above and an internal combustion engine that is subjected to automatic stop/automatic restart control according to stop/start of the vehicle.

Even if the state of combustion of the internal combustion engine is deteriorated once, the deterioration in the state of combustion is often resolved when the engine is started next time after the ignition system is turned off in the case where the factor of the deterioration is temporary. Therefore, the throttle opening degree during idle operation may be controlled using the first learned value when the engine is started next time after the ignition system is turned off.

On the other hand, the throttle opening degree during idle operation may be controlled using the second learned value when the state of combustion is deteriorated, until the deteriorated state is resolved.

The control system for an internal combustion engine according to the invention is suitable for application to internal combustion engines that have a low frequency of idle operation and have limited chances to learn a throttle opening degree during idle operation at which a target idle speed can be obtained. For example, the invention is suitable for application to an internal combustion engine that is mounted on a hybrid vehicle that includes two driving power sources, namely the internal combustion engine and a motor, an internal combustion engine that is mounted on a vehicle and that is subjected to automatic stop/automatic restart control according to stop/start of the vehicle, and so forth.

The invention has been described with reference to example embodiments for illustrative purposes only. It should be understood that the description is not intended to be exhaustive or to limit form of the invention and that the invention may be adapted for use in other systems and applications. The scope of the invention embraces various modifications and equivalent arrangements that may be conceived by one skilled in the art.

What is claimed is:

1. A control system for an internal combustion engine that performs learning of a throttle opening degree during idle operation, at which a target idle speed can be obtained, the control system comprising:

an electronic control unit; and a throttle valve that adjusts an amount of intake air into the internal combustion engine by varying the throttle opening degree, the throttle valve sets the throttle opening degree to one of a first learned value and a second learned value during idle operation based on input from the electronic control unit;

the electronic control unit is configured to update the first learned value when a state of combustion is not deteriorated, and update the second learned value when the state of combustion is deteriorated, the electronic control unit is configured to operate the throttle valve to set the throttle opening degree, during idle operation, to the first learned value when the internal combustion engine is started next time after an ignition system of the internal combustion engine is turned off.

2. The control system according to claim 1, further comprising a crank angle sensor that detects a rotational angle of a crankshaft of the internal combustion engine, wherein the electronic control unit is configured to calculate variations in engine speed during operation of the internal combustion engine based on a result of detection performed by the crank angle sensor and the electronic control unit is configured to determine an occurrence of deterioration in the state of combustion based on the variations.

3. The control system according to claim 1, wherein the electronic control unit is configured to control the throttle opening degree during idle operation with the use of the second learned value when the state of combustion is deteriorated, until the deteriorated state is resolved.

4. The control system according to claim 1, wherein the electronic control unit is configured to control the throttle opening degree during idle operation with the use of the second learned value until an ignition system of the internal combustion engine is turned off after the state of combustion is deteriorated, provided that a frequency of recurrence of deterioration in the state of combustion is high.

5. The control system according to claim 1, wherein the internal combustion engine is configured to be mounted on a hybrid vehicle that includes two driving power sources, which are the internal combustion engine and an electric motor.

6. The control system according to claim 1, wherein the internal combustion engine is configured to be subjected to control in which the internal combustion engine is automatically stopped and automatically restarted in accordance with stop and start of a vehicle, on which the internal combustion engine is mounted.

7. A control method for an internal combustion engine that performs learning of a throttle opening degree during idle operation, at which a target idle speed can be obtained, the control method comprising:

adjusting an amount of intake air into the internal combustion engine by setting the throttle opening degree of a throttle value to one of the a first learned value and a second learned value during idle operation based on input from an electronic control unit;

updating, by the electronic control unit, the first learned value when a state of combustion is not deteriorated;

updating by the electronic control unit, the second learned value when the state of combustion is deteriorated;

operating the throttle valve, by the electronic control unit, to set the throttle opening degree, during idle operation, to the first learned value when the engine is started next time after an ignition system of the internal combustion engine is turned off.

8. The control method according to claim 7, further comprising calculating, by the electronic control unit, variations in engine speed during operation of the internal combustion engine based on a result of detection performed by a crank angle sensor that detects a rotational angle of a crankshaft of the internal combustion engine; and determining, by the electronic control unit, an occurrence of deterioration in the state of combustion based on the variations.

9. The control method according to claim 7, further comprising controlling, by the electronic control unit, the throttle opening degree during idle operation with the use of the second learned value when the state of combustion is deteriorated, until the deteriorated state is resolved.

10. The control method according to claim 7, further comprising controlling, by the electronic control unit, the throttle opening degree during idle operation with the use of the second learned value until an ignition system of the internal combustion engine is turned off after the state of combustion is deteriorated, provided that a frequency of recurrence of deterioration in the state of combustion is high.

11. The control method according to claim 7, wherein the internal combustion engine is configured to be mounted on a hybrid vehicle that includes two driving power sources, which are the internal combustion engine and an electric motor.

12. The control method according to claim 7, wherein the internal combustion engine is configured to be subjected to control in which the internal combustion engine is automatically stopped and automatically restarted in accordance with stop and start of a vehicle on which the internal combustion engine is mounted.

* * * * *

UNITED STATES PATENT AND TRADEMARK OFFICE

CERTIFICATE OF CORRECTION

PATENT NO. : 9,273,624 B2
APPLICATION NO. : 13/423568
DATED : March 1, 2016
INVENTOR(S) : Yukio Kobayashi It is certified that error appears in the above-identified patent and that said Letters Patent is hereby corrected as shown below:

In Claims,

Column 7, Line 26, claim 7, delete "the" after "one of".

Signed and Sealed this
Seventeenth Day of May, 2016

Michelle K. Lee

Michelle K. Lee
*Director of the United States Patent and Trademark Office*